US007669705B2

(12) United States Patent
Yu

(10) Patent No.: US 7,669,705 B2
(45) Date of Patent: Mar. 2, 2010

(54) COIN RECOGNITION DEVICE

(75) Inventor: Baoliu Yu, Shenzhen (CN)

(73) Assignee: Jin Jiang Zhanwang Electronic (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 12/204,291

(22) Filed: Sep. 4, 2008

(65) Prior Publication Data

US 2010/0000839 A1 Jan. 7, 2010

(51) Int. Cl.
*G07D 5/02* (2006.01)

(52) U.S. Cl. ..... 194/336; 194/334

(58) Field of Classification Search ..... 194/336
See application file for complete search history.

(56) References Cited

U.S. PATENT DOCUMENTS 3,941,226 A * 3/1976 Drakes ..... 194/216
RE31,085 E * 11/1982 Greenwald et al. ..... 194/234
4,673,368 A * 6/1987 Bush ..... 446/8

* cited by examiner

*Primary Examiner*—Patrick Mackey
*Assistant Examiner*—Mark Beauchaine
(74) *Attorney, Agent, or Firm*—Morris, Manning & Martin LLP; Tim Tingkang Xia

(57) ABSTRACT

The present invention provides a coin recognition device comprising an integrated circuit, a coin receiving member, and a retractable trigger mechanism. The integrated circuit comprises a built-in recognition program and a plurality of pads as signal input ends thereof. The recognition program is configured for discriminating denomination of coins based on signals from the pads. The coin receiving member defines a coin slot for coins to be inserted. The retractable trigger mechanism is associated with the coin slot and is disposed on the coin receiving member. The trigger mechanism comprises a conductive contact part attached thereto. The contact part moves together with movement of the trigger mechanism in response to the insertion of coins. When the contact part moves to corresponding positions in relation to varying diameters of coins, the contact part at each specific position is electrically connected to one respective pad to stimulate a signal.

16 Claims, 3 Drawing Sheets

COIN RECOGNITION DEVICE

FIELD OF THE INVENTION

The present invention relates to coin recognition machines and, more particularly to a coin recognition device which determines denomination by discriminating diameter of the coins.

BACKGROUND

Coin recognition devices, or coin discriminators, are widely used in, e.g., coin counting machines for identifying the type (e.g. denomination) of each coin that is processed by the machine. The known procedures for the recognition of coins analyze in particular the criteria weight, diameter, thickness, electrical-magnetic and light permeable properties of the coin's alloy.

A typical coin recognition device discriminates whether or not coins are acceptable and the denomination of coins by optically detecting method. For example, this coin recognition device includes a light source, a single-chip computer electrically connected to an optical signal receiver, and a display. A passageway is disposed between the light source and the optical signal receiver, for allowing a piece of coin to roll through. A coin backrest is arranged in the passageway. The coin in the passageway transfers along the backrest under drive of a coin propeller. The optical signal receiver extends at least two optical fibers at receiving end thereof. One end of each optical fiber faces toward the passageway and the other end is connected to the single-chip computer by a photoeletric sensor. While one coin rolls through the passageway, parts of the optical fibers is not permeable through the coin, i.e., reflected from the coin. Accordingly, the coin recognition device discriminates the denomination of coins by identifying the diameter of the coins rolling through the passageway based on amount of reflected optical fibers. However, this coin recognition device has a complicated construction and is expensive due to the optical fibers.

SUMMARY

An object of the present invention is to provide a coin recognition device, which has a compact structure and reduces cost.

To achieve the above object, in accordance with an aspect of the present invention, a coin recognition device is provided. The coin recognition device comprises an integrated circuit, a coin receiving member, and a retractable trigger mechanism. The integrated circuit comprises a built-in recognition program and a plurality of pads as signal input ends thereof. The recognition program is configured for discriminating denomination of coins based on signals from the pads. The coin receiving member defines a coin slot for coins to be inserted. The retractable trigger mechanism is associated with the coin slot and is disposed on the coin receiving member. The trigger mechanism comprises a conductive contact part attached thereto. The contact part moves together with movement of the trigger mechanism in response to the insertion of coins. When the contact part moves to corresponding positions in relation to varying diameters of coins, the contact part at each specific position is electrically connected to one respective pad to stimulate a signal.

Other objects, advantages and novel features of the present invention will become more apparent from the following detailed description when taken in conjunction with the accompanying drawings.

BRIEF DESCRIPTION OF THE DRAWINGS

Many aspects of the coin recognition device can be better understood with reference to the following drawings. The components in the drawings are not necessarily to scale, the emphasis instead being placed upon clearly illustrating the principles of the present thermal interface material. Moreover, in the drawings, like reference numerals designate corresponding parts throughout the several views.

DETAILED DESCRIPTION OF THE PREFERRED EMBODIMENTS

The following exemplary coin recognition device is described with reference to the accompanying drawings to illustrate the present device. It is to be noted that the present device can be applied in various fields coin inserting relates to, for example, coin counting machines, coin sorting machines, and so on, but not limited to these exemplary fields.

Figure 1:
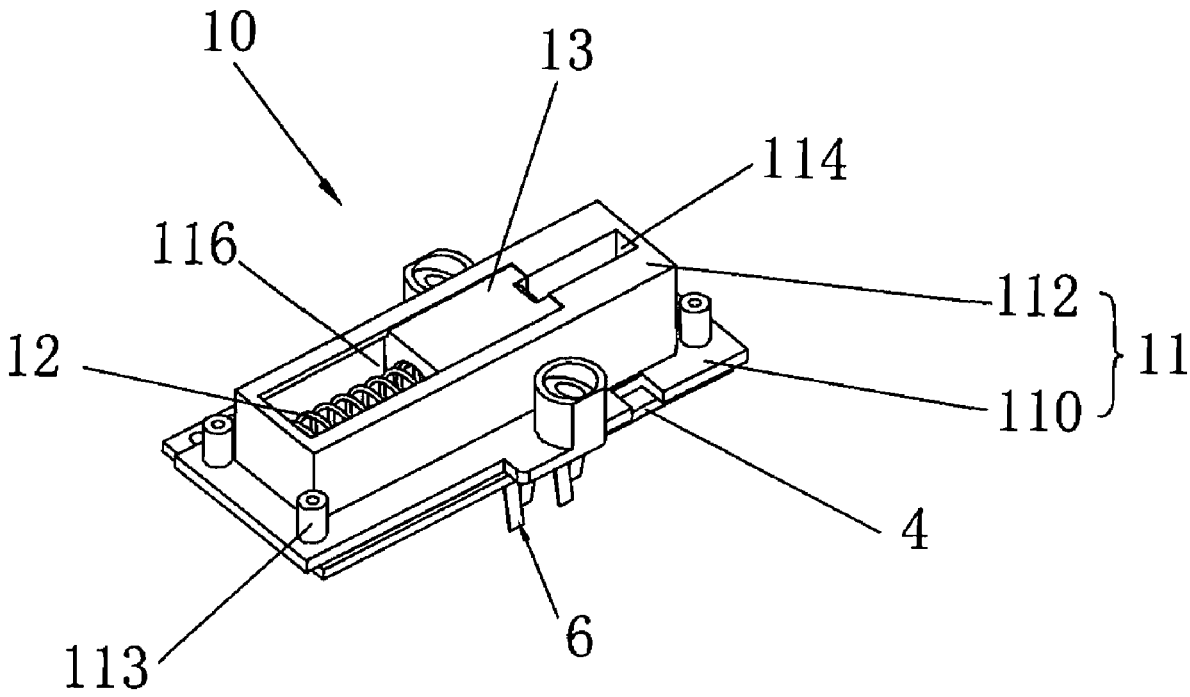
FIG. 1 is a schematic, isometric view of a coin recognition device, in accordance with a preferred embodiment of the present invention.
Figure 2:
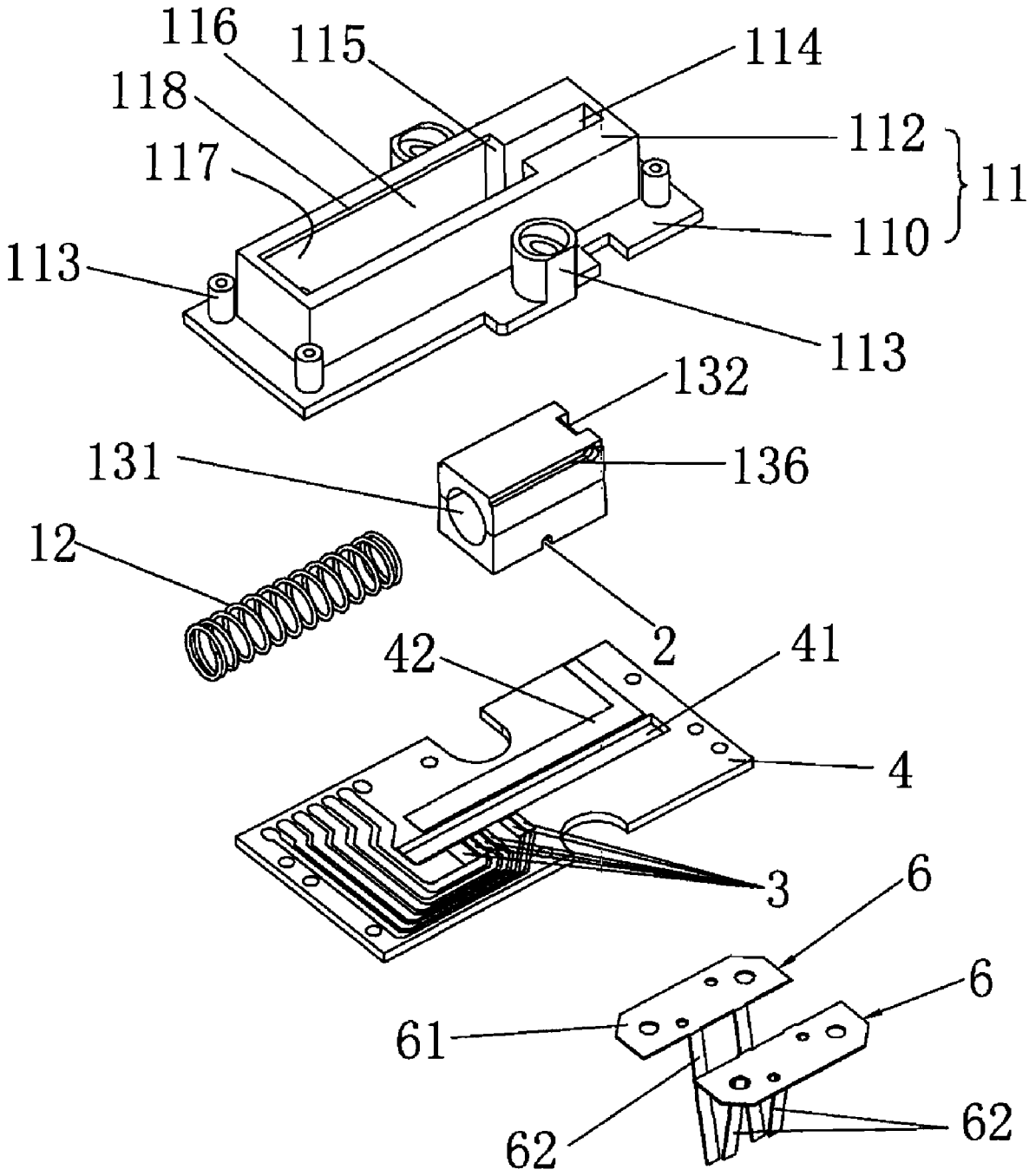
FIG. 2 is a schematic, disassembled view of the coin recognition device of FIG. 1.

Referring to FIGS. 1 and 2, in accordance with an embodiment of the present invention, a coin recognition device 10 includes an integrated circuit, a coin receiving member and a retractable trigger mechanism.

The integrated circuit may use a typical integrated circuit (not shown) provided with a built-in recognition program. The integrated circuit comprises a plurality of pads 3 as a signal input end thereof. The recognition program is configured for discriminating and/or indicating denomination of coins based on input signals originating from the pads 3.

In the illustrated embodiment, the coin receiving member 11 includes a base 110 and a guide block 112 disposed on the base 110. The base 110 is used to facilitate fixation of the device 10 to other peripheral equipment by, e.g., a plurality of central hollow protrusions 113. The guide block 112 defines a coin slot 114 and a slide cavity 116 communicating with the coin slot 114. The slide cavity 116 has a width greater than that of the coin slot 114 corresponding to thickness of the coins, thereby forming a baffle wall 115.

The retractable trigger mechanism is associated with the coin slot 114. In the illustrated embodiment, the trigger mechanism includes a slide member 13 and an elastic member 12 both received in the slide cavity 116. One end of the elastic member 12 engages with the slide member 13 and the other end is fixed to the coin receiving member, i.e., the guide block 112. The elastic member 12 is a retractable member, e.g., a spring 12, as shown in FIG. 2. One end of the slide member 13 is disposed toward the coin slot 114 and is pressed to move along the slide cavity 116 by the inserted coins.

The slide member 13 defines a non-through hole 131, for receiving the end of the spring 12, as shown in FIG. 2. The slide member 13 is, advantageously, a rectangular slide engaging with two elongated sidewalls 117 around the slide cavity 116. The slide member 13 and the two elongated sidewalls 117 cooperatively form a slide mechanism for guiding the slide of the slide member 13 in the slide cavity 116. The slide mechanism includes, e.g., guide rail and guide groove. Specifically, the two sidewalls 117 each form a guide rail 118 thereon, as shown in FIG. 2. The slide member 13 defines two guide grooves 136 at two sides thereof corresponding to the two guide rail 118. Accordingly, the slide member 13 is able to smoothly slide in the slide cavity 116. Alternatively, the guide rail 118 could be projected from the slide member 13 and two guide grooves 136 are defined in the two sidewalls 117.

Since the width of the slide cavity 116 is greater than that of the coin slot 114, the slide member 13 is prevented to move into the coin slot 114. In an initial status where no coin is inserted into the coin slot 114, the spring 12 is usefully in a slight contracted status such that the slide member 13 presses against the baffle wall 115. In such an initial status, the width of the coin slot 114 is defined to be narrower than coins to be inserted. When a coin is passing through the coin slot 114, the slide member 13 is forced to move along the guide rail 118 in the slide cavity 116 and presses against the spring 12.

To provide convenience for smoothly inserting the coin through the coin slot 114, the slide member 13 has a chamfered edge 132 disposed toward the coin slot 114. The chamfered edge 132 of the slide member 13 is, beneficially, a round chamfered edge. Further, the chamfered edge 132 is a sunken portion having the same width to the width of the coin slot 114.

Figure 3:
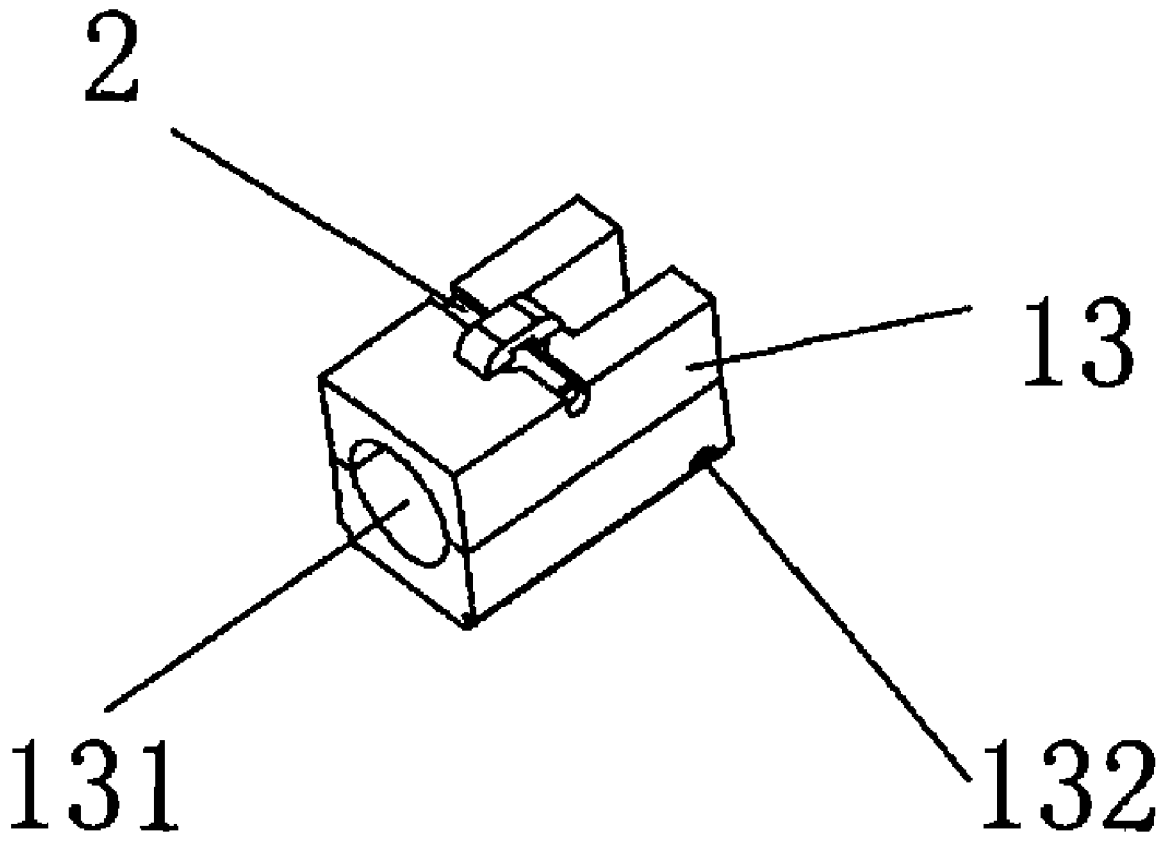
FIG. 3 is schematic, isometric, bottom side view of a slide member of the coin recognition device of FIG. 1.

The device 10 further includes a substrate, e.g., a printed circuit board (PCB) 4. The PCB 4 is attached to the coin receiving member 11. The plurality of pads 3 is formed on the PCB 4. As shown in FIG. 3, a conductive contact part 2 is attached to the slide member 13. The contact part 2 could be made of a metal material such as copper, silver or an alloy thereof. The contact part 2 moves together with movement of the slide member 13 of the trigger mechanism in response to insertion of coins.

The PCB 4 defines a leaking slot 41 aligned with the coin slot 114, for allowing the inserted coins to further penetrate therethrough. The plurality of pads 3 is spaced according to the varying diameters of coins. The plurality of pads 3 is aligned at a side of the leaking slot 41. An elongated contact strip 42 is formed on the other side of the leaking slot 41 opposite to the pads 3. The contact strip 42 is electrically connected to the integrated circuit.

When inserting the coins, the contact part 2 moves to corresponding different positions in relation to varying diameters of inserted coins. The contact part 2 at each specific position electrically connects one respective pad 3 to the contact strip 42. Then the contact strip 42 conducts a specific signal to the integrated circuit. The integrated circuit discriminates and indicates the denomination of inserted coin according to the specific signal. As such, the discrimination of the denomination of coins is achieved.

A pair of spaced conductive contact sheets 6 is separately attached at a bottom surface of the PCB 4 and is disposed at two sides of the leaking slot 41. The bottom surface of the PCB 4 faces away from a surface with the pads formed thereon. One of the pair of spaced conductive contact sheets 6 is adjacent and electrically connected to the contact strip 42. Each contact sheet 6 includes an attaching pad 61 secured to the substrate 4 and two pins 62 projecting outward from the attaching pad 61. The pins 62 of the pair of sheets 6 form such a means that the two contact sheets form electrical connection therebetween when each inserted coin passes through the two contact sheets. Specifically, the two pins 62 of one contact sheet 6 extend toward the two pins 62 of the other contact sheet 6, thereby cooperatively forming a claw-shaped structure. When each inserted coin falls between the pins 62, an electrical connection is formed between the two contact sheets 6. This electrical connection between the contact sheets 6 stimulates a confirmation circuit built-in the integrated circuit to confirm that the coin is accommodated in the device 10. The coin subsequently further passes through the two contact sheets 6 and is accommodated in the device 10.

In operation, the retractable trigger mechanism in the present device 10 can move away to allow the inserting coin to pass through in response to insertion of coins. The contact part 2 moves along with movement of the trigger mechanism and connects one specific pad to the integrated circuit, thereby transmitting a recognition signal to the integrated circuit. The device 10 uses a plurality of pads cooperating with the contact part of the trigger mechanism to stimulate the recognition program. The entire structure device 10 is compact, accordingly reducing cost.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A coin recognition device, comprising:

an integrated circuit comprising a built-in recognition program and a plurality of pads as signal input ends thereof, the recognition program being configured for discriminating denomination of coins based on signals from the pads;

a coin receiving member defining a coin slot for coins to be inserted;

a retractable trigger mechanism associated with the coin slot and disposed on the coin receiving member, the trigger mechanism comprising a conductive contact part attached thereto, the contact part moving together with movement of the trigger mechanism in response to the insertion of coins, when the contact part moves to corresponding positions in relation to varying diameters of coins, the contact part at each specific position is electrically connected to one respective pad to stimulate a signal; and a substrate defining a leaking slot aligned with the coin slot, for allowing the inserted coins to penetrate therethrough, wherein the plurality of pads is aligned at a side of the leaking slot.

2. The coin recognition device as claimed in claim 1, wherein the trigger mechanism further comprises a slide member and an elastic member with one end engaging with the slide member and the other end fixed to the coin receiving member, the contact part being attached to the slide member.

3. The coin recognition device as claimed in claim 2, wherein the elastic member is a spring, the slide member defining a non-through hole for receiving an end of the spring.

4. The coin recognition device as claimed in claim 2, wherein the coin receiving member defines a slide cavity for receiving the slide member and the elastic member therein, the slide cavity communicating with the coin slot such that one end of the slide member is disposed toward the coin slot and is pressed to move along the slide cavity by the inserted coins.

5. The coin recognition device as claimed in claim 4, wherein the slide cavity is defined between two sidewalls of the receiving member, the two sidewalls and the slide member cooperatively forming a slide mechanism for guiding the slide of the slide member in the slide cavity.

6. The coin recognition device as claimed in claim 5, wherein the slide mechanism comprises guide rail and guide groove separately formed on the two sidewalls and the slide member.

7. The coin recognition device as claimed in claim 4, wherein the slide cavity defines a width greater than that of the coin slot corresponding to thickness of the coins, thereby preventing the slide member from moving into the coin slot.

8. The coin recognition device as claimed in claim 1, wherein a contact strip is formed on the other side of the leaking slot opposite to the pads, the contact strip being electrically connected to the integrated circuit.

9. The coin recognition device as claimed in claim 8, further comprising a pair of spaced conductive contact sheets separately disposed at a bottom surface of the substrate, the pair of contact sheets being disposed at two sides of the leaking slot, one of the pair of contact sheets being disposed and electrically connected to the contact strip, the other contact sheet being connected to a confirmation circuit built-in the integrated circuit.

10. The coin recognition device as claimed in claim 9, wherein each contact sheet comprises an attaching pad secured to the substrate and two pins projecting out of the attaching pad, the pins of the pair of sheets forming such a means that the two contact sheets form electrical connection therebetween when each inserted coin passes through the two contact sheets.

11. The coin recognition device as claimed in claim 8, wherein the plurality of pads is formed on the substrate, the trigger mechanism being disposed on a surface of the substrate with the pads formed thereon, the contact part being attached to a bottom position of the trigger mechanism corresponding to the leaking slot, the contact part forming an electrical connection between the contact strip and one respective pad in response to the insertion of one specific coin.

12. The coin recognition device as claimed in claim 1, wherein the substrate is a printed circuit board.

13. The coin recognition device as claimed in claim 1, wherein the coin receiving member comprises a base provided with a plurality of central hollow protrusions and a guide block disposed on the base, the plurality of central hollow protrusions being configured for fixing the base on a peripheral equipment.

14. The coin recognition device as claimed in claim 1, wherein the slide member has a chamfered edge disposed toward the coin slot.

15. The coin recognition device as claimed in claim 14, wherein the chamfered edge of the slide member is a round chamfered edge.

16. The coin recognition device as claimed in claim 14, wherein the chamfered edge is a sunken portion having the same width to the width of the coin slot.

* * * * *